United States Patent [19]

Morrissey

[11] 4,049,508

[45] Sept. 20, 1977

[54] TIN-NICKEL PLATING

[75] Inventor: Ronald J. Morrissey, Cranston, R.I.

[73] Assignee: Technic, Inc., Cranston, R.I.

[21] Appl. No.: 685,654

[22] Filed: May 12, 1976

Related U.S. Application Data

[63] Continuation-in-part of Ser. No. 549,357, Feb. 12, 1975, abandoned.

[51] Int. Cl.[2] ..... C25D 3/60

[52] U.S. Cl. ..... 204/43 S

[58] Field of Search ..... 204/43 S, 43 T; 106/1

[56] References Cited

U.S. PATENT DOCUMENTS

| | | | |
|---|---|---|---|
| 2,658,866 | 11/1953 | Parkinson | 204/43 S |
| 2,926,124 | 2/1960 | Taylor et al. | 204/43 S |
| 3,002,901 | 10/1961 | Seyb | 204/43 S |
| 3,772,168 | 11/1973 | Dillenberg | 204/43 S |
| 3,940,319 | 2/1976 | Pollack | 204/43 S |

*Primary Examiner*—G. L. Kaplan

*Attorney, Agent, or Firm*—Eugene E. Geoffrey, Jr.

[57] ABSTRACT

Electroplating bath for the electrodeposition of tin-nickel alloys, approximating 65% by weight of tin and 35% by weight of nickel, said alloy being deposited over a wide range of current density, from a bath consisting essentially of (i) nickel sulfamate concentrate sufficient to give about 10 ounces of nickel per gallon, and (ii) ammonium bifluoride to the amount of about 1 pound per gallon, and (iii) stannous fluoride sufficient to give about 4 ounces of tin metal per gallon.

The bath is strongly self-buffered to a pH 4.3 to 4.5, but operable in the pH range of 4.0 to 5.5.

Said bath is operable to place the said amount of tin and nickel at any temperature about 60° C at a current density from 0 up to and exceeding 40 amperes per square foot when temperature is in the range of 74° to 77° C.

The deposit is bright, of low compressive stress, and exhibits an extraordinary resistance to corrosion.

1 Claim, No Drawings

TIN-NICKEL PLATING

RELATED APPLICATIONS

This application is a continuation-in-part of my copending application Ser. 549,357, filed Feb. 12, 1975, now abandoned and assigned to the assignee of the instant application.

DETAILED DESCRIPTION OF THE INVENTION

The bath is formulated in two solutions which are mixed in equal proportions to form the working bath. To make one gallon of the working bath, preferred formulation is as follows:

| | |
|---|---|
| Solution A: | ½ gallon |
| Nickel Sulfamate concentrate (20-22 ounces nickel/gallon) | |
| Solution B: | ½ gallon |
| Ammonium Bifluoride (or Ammonium Fluoride) | 1 pound (454 gm) |
| Stannous Fluoride | ⅓ pound (150 gm) |
| Water to volume | |

Useful concentrations of nickel in the working bath are in the range of about 5–15 ounces of nickel metal per gallon. Useful concentrations of tin in the working bath are in the range of about 2–6 ounces of tin metal per gallon, which would correspond to stannous fluoride concentrations of about 1/6 pound to ½ pound per gallon of working solution, respectively.

Actually, the working bath will plate the desired alloy even when the concentrations of the constituent metals are appreciably lower than the ranges given. In one test, the desired alloy was plated up to a current density of 6 amperes per square foot when the tin metal concentration was only 0.4 ounce per gallon of working bath.

CHEMISTRY

The chemical expression for the formation of the plateable tin-nickel complex $NiSnF_4$ in this system is considered to be as follows:

(I)

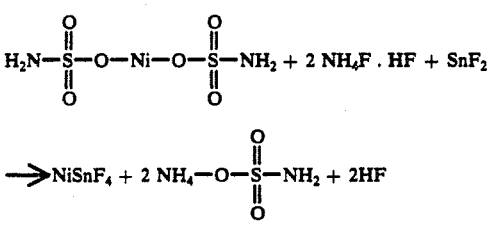

A large excess of nickel sulfamate is provided, so that the liberated HF can react, as:

(II)

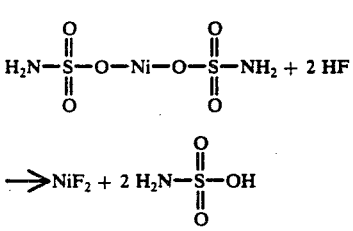

or

-continued (III)

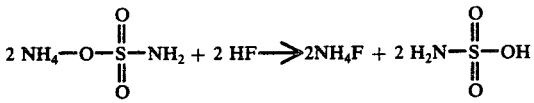

At the buffered pH, reactions II and III are considered to proceed largely to completion, so that in the working bath, the concentration of free HF is sufficiently low to permit routine pH determination by means of a conventional glass-electrode pH meter. Nickel fluoride is only sparingly soluble and tends to separate from the solution, particularly if the bath is stored for extended periods at room temperature. Substitution of ammonium fluoride for ammonium bifluoride in the bath make-up would appear to eliminate the formation of HF, as the reaction would then be:

(IV)

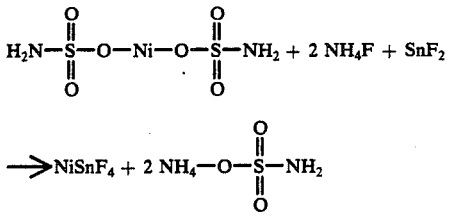

In practice, however, solutions of ammonium fluoride when heated convert to the bifluoride with loss of ammonia, so that as the bath is used, the dominant reaction for the formation of $NiSnF_4$ will be reaction (I) regardless of whether ammonium fluoride or ammonium bifluoride is used for makeup.

REPLENISHMENT

The bath is ordinarily operated with nickel anodes, and nickel is automatically replenished in the solution by anode corrosion and dissolution. Nickel content may be adjusted by addition of nickel sulfamate concentrate if desired. Anode corrosion improves with increasing bath temperature, and at temperatures about 74° C (165° F) the anode current efficiency is substantially 50% (100% for replenishment of nickel). The cathode current efficiency in this bath is substantially 100% at all temperatures within the operating range.

Replenishment of tin is accomplished by addition of stannous fluoride at a rate of 1.33 grams (1.1 gm tin metal) per ampere-hour. In a working tin-nickel bath there is usually some loss of fluoride due to evaporation and dragout. This can be compensated for by replenishment using makeup solution B at a rate of 20 milliliters per ampere-hours, in which case the fluoride is automatically replenished along with the tin. Alternatively, a solid mixture of stannous fluoride and ammonium bifluoride or ammonium fluoride may be used.

Stannous tin in a heated tin-nickel solution tends to oxidize to the stannic state, forming the complex $NiSnF_6$. This sequesters both tin and fluoride from the bath, as the $NiSnF_6$ complex is not a plateable species. The concentration of $NiSnF_6$ in the bath will increase until it reaches equilibrium with the plateable species $NiSnF_4$. The rate at which this process takes place will be influenced by the type and rate of usage of the bath, the stannous ion concentration, and the bath pH.

When the tin-nickel bath is first placed in operation, it is well to analyze frequently for stannous tin until the stannous-stannic equilibrium is achieved, after which replenishment of stannous tin may be calculated on the basis of the normal rate of 1.1 grams of tin metal per ampere-hour. In a test conducted with a 30 gallon tin-nickel bath prepared according to this formulation and operated continuously at 74° C (165° F), the stannous-stannic equilibrium was attained within the first 150 ampere-hours.

OPERATION

Various operating parameters of the tin-nickel bath may be summarized as follows:

Temperature: 60° C (140° F) or greater. Optimum plating temperature is 74°–77° C (165°–170° F)

pH: 4.0–5.5. Systems is self-buffered at pH 4.3–4.4.

Anodes: Depolarized nickel. Anode-to-cathode area ratio should be at least 1:1. Anode bags of loosely-woven dynel or polypropylene may be used.

Heaters: Karbate or heavily nickel-plated stainless. Teflon-jacketed steam coils or plastic-lined water-jacketed tanks may be used.

Current Density: Bright range increases with temperature. At 60° C (140° F) plating range is zero to 15 A.S.F. At 70° C (158° F), range is zero to 25 A.S.F. At 75° C (167° F), range is zero to 40 A.S.F.

Deposition Rate: At 5 A.S.F., deposition rate is 6 microinches per minute. At 10 A.S.F., rate is 12 microinches per minute. At 20 A.S.F., rate is 24 microinches per minute, and so on.

Agitation: None required. The bath may be pumped and continuously filtered if desired. Plastic apparatus and non-silicated filter aids should be used.

Dummying: Prior to makeup, the nickel sulfamate Solution A may be dummied at approximately 1 ampere per sq. foot for a sufficient time to accumulate 20–30 ampere hours per gallon. Alternately, the complete bath may be dummied at the same current density for a sufficient time to accumulate 10–15 ampere hours per gallon.

CONTROL

The tin-nickel bath is designed for maximum ease of control particularly with regard to pH stability, which is a major problem area in previous tin-nickel plating formulations. Analytical and control procedures for this bath are as follows:

pH: Should be measured electrometrically, as the bath tends to bleach most pH indicator papers. It should be noted that not all pH meters will provide identical readings, due to differences in construction of various glass electrodes, and to differences in their indicating characteristics with age and use. We standardize the pH meter with pH 4.0 buffer prior to reading the pH of the tin-nickel bath. pH of the tin-nickel bath may be raised if necessary with ammonium hydroxide and lowered with sulfamic acid.

Note: A rise in bath pH, together with a loss of brightness at high current density, is indicative of low nickel concentration.

ANALYSIS FOR NICKEL

1. Pipette 2 milliliters of bath into 250 milliliter erlenmeyer flask and dilute to 150 milliliters with deionized water
2. Add 10 milliliters concentrated $NH_4OH$.
3. Add 0.05 grams murexide indicator
4. Titrate with 0.1 molar ethylene diamine tetra acetic acid (EDTA) to bright magenta end point.
5. Calculation: ML. 0.1 M EDTA × 0.39 = nickel in ounces/gallon. Bath is nominally at a concentration of 10–10.5 ounces nickel/gallon

ANALYSIS FOR STANNOUS TIN

1. Pipette 2 milliliters of bath into 250 milliliters erlenmeyer flask containing 100 milliliters of dilute hydrochloric acid (1.1) and 5 milliliters starch solution
2. Add 5 grams sodium bicarbonate
3. Titrate immediately with 0.1 N potassium iodide iodate to dark blue end point
4. Calculation: ML 0.1 N potassium iodide iodate × 0.40 = stannous tin in ounces/gallon. Bath is nominally at a concentration of 4.0 ounces/gallon in stannous tin.

CONTROL OF FLUORIDE

As there is no really convenient analytical procedure for fluoride in this bath, the best procedure for routine control is to establish that the nickel and stannous tin concentrations and bath pH are correct, and then to run a 1-ampere Hull cell panel on a sample of the bath for 5 minutes without agitation at 74°–77° C (165° F–170° F). The resulting panel should be bright and uniform almost to the high current density edge. Low fluoride will cause a loss of brightness, particularly at high current densities. Add ammonium bifluoride to the Hull cell in increments of 2 grams, running additional panels after each addition. (Caution: No more than 3–4 Hull cell panels should be run from a single 267 milliliter aliquot of bath). When brightness of the Hull cell panel is re-established, correct the main bath by adding 1 ounce per gallon of ammonium bifluoride for every 2 grams added to the Hull cell.

OPERATING AND SERVICING THE BATH

Experience with this bath has shown that control is easiest if the various analytical and replenishment procedures are performed in the order as follows:

1. Check bath pH.
2. Analyze for nickel and stannous tin.
3. Replenish nickel and stannous tin in main bath.
4. Re-check bath pH.
5. Correct fluoride in Hull cell.
6. Correct fluoride in main bath.
7. Re-check bath pH; adjust if needed.

What is claimed is:

1. An aqueous electroplating bath for plating an alloy consisting substantially of 65 weight percent tin and 35 weight percent nickel, said bath consisting, per gallon of bath, of a. ½ gallon of an aqueous solution containing about 20–22 ounces per gallon of said solution of nickel in the form of nickel sulfamate, and b. ½ gallon of an aqueous solution containing about ⅓ pound of stannous fluoride and about 1 pound of either ammonium bifluoride or ammonium fluoride, said plating bath incorporating a buffering agent consisting of ammonium sulfamate which is formed in situ on mixing of solutions A and B, to give a pH in the range of 4.0 to 5.5.

* * * * *